US005242365A

United States Patent [19]

Counts et al.

[11] Patent Number: 5,242,365

[45] Date of Patent: Sep. 7, 1993

[54] PROCESS FOR MANUFACTURING PACKAGE HAVING SEPARABLE OVERLAY

[75] Inventors: Mary C. Counts, Florence, Ala.; Harry Zimmerman, Jr., Kenova, W. Va.

[73] Assignees: Anco Collector Supplies, Inc., Florence, Ala.; Zim's Bagging Company, Inc., Prichard, W. Va.

[21] Appl. No.: 944,195

[22] Filed: Sep. 11, 1992

[51] Int. Cl.[5] ..... B31B 23/14; B31B 23/26; B31B 23/60; B31B 23/88

[52] U.S. Cl. ..... 493/188; 493/195; 493/467; 493/961

[58] Field of Search ..... 493/187, 188, 194, 195, 493/227, 233, 326, 467, 961

[56] References Cited

U.S. PATENT DOCUMENTS

| | | | |
|---|---|---|---|
| Re. 24,962 | 4/1961 | Loderhose | 229/70 |
| 3,308,722 | 3/1967 | Peterson | 493/187 |
| 4,262,581 | 4/1981 | Ferrell | 493/188 |
| 4,537,586 | 8/1985 | Gale et al. | 493/220 |
| 4,551,125 | 11/1985 | Pezzana et al. | 493/217 |
| 4,617,683 | 10/1986 | Christoff | 493/302 |
| 4,849,040 | 7/1989 | Wood | 493/188 |
| 4,955,479 | 9/1990 | Beer et al. | 206/455 |
| 5,011,466 | 4/1991 | DeMatteis et al. | 493/188 |

FOREIGN PATENT DOCUMENTS

| | | | |
|---|---|---|---|
| 361610 | 10/1922 | Fed. Rep. of Germany | 493/188 |
| 3829602 | 3/1990 | Fed. Rep. of Germany | 493/187 |

OTHER PUBLICATIONS

Photocopy of Atkinson's package, described in specification; dating prior to Sep. 11, 1992.

*Primary Examiner*—William E. Terrell
*Attorney, Agent, or Firm*—Kalish & Gilster

[57] ABSTRACT

A package having a separable overlay is formed by a high speed web roll manufacturing method and adapted for multiple marketing of retail goods. The package has at least three layered sheets of flexible material, the outermost sheet being quickly and easily removable from the remainder of the package without disruption thereof. The package may thus be converted from one for marketing goods under a label of a seasonal or special nature to a package for marketing goods under a label of a general or everyday nature, to thereby extend the profitable shelf-life of the package.

9 Claims, 5 Drawing Sheets

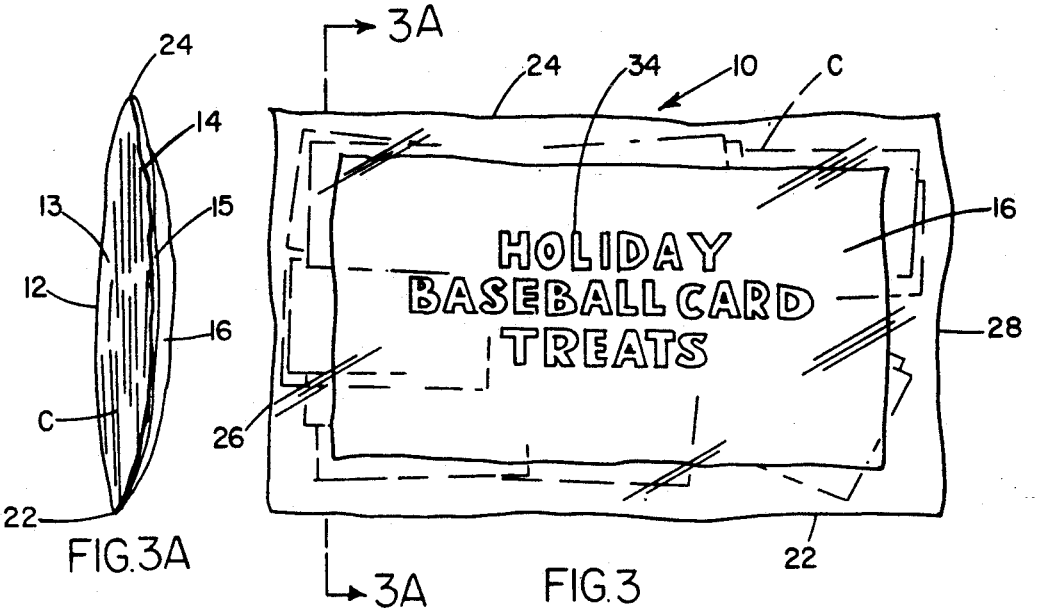
3A
24
14
13
15
12
16
C
22
FIG.3A
24
34
10
C
16
HOLIDAY
BASEBALL CARD
TREATS
28
26
22
3A
FIG.3
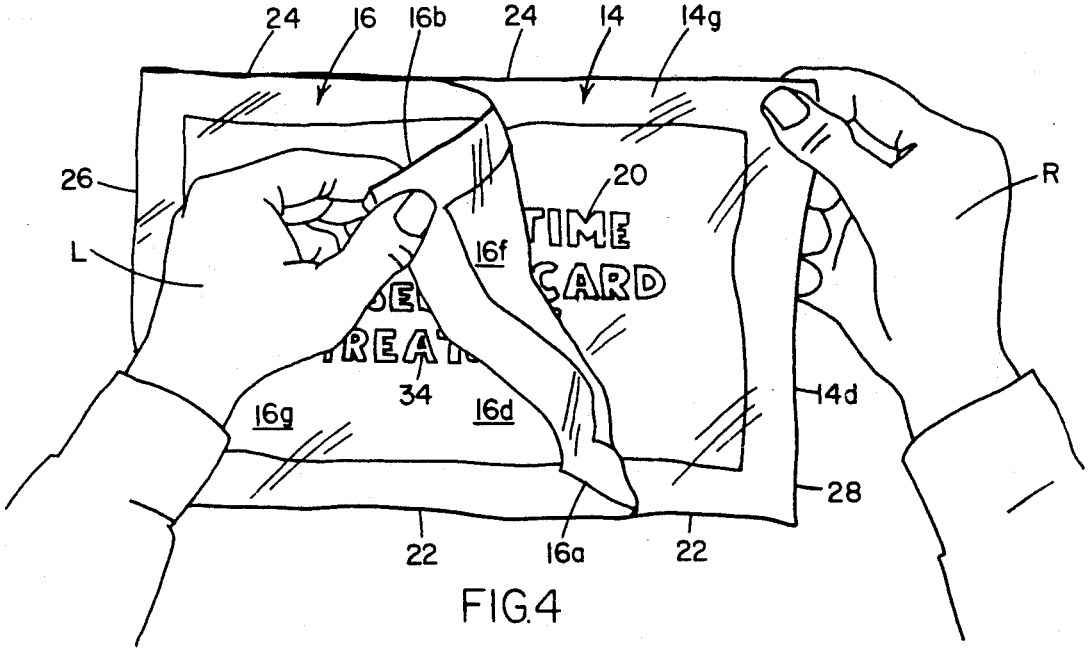
24
16
16b
24
14
14g
26
L
20
R
16f
TIME
CARD
34
16g
16d
14d
28
22
16a
22
FIG.4

PROCESS FOR MANUFACTURING PACKAGE HAVING SEPARABLE OVERLAY

BACKGROUND AND SUMMARY OF THE INVENTION

1. Field of the Invention

This invention relates, in general, to packages for marketing retail goods, and, more specifically, to a flexible package having a detachable decorative overlay portion which is made separable to allow the retailer to provide specialized marketing information which is removable from the body of the package so as to extend the full price marketing life of the particular packaged goods.

2. Description of the Prior Art

Heretofore, when retailers provided goods, such as candy, toys, or treats such as baseball cards, in small packages bearing information of a special event or seasonal nature, for example, for Halloween, July Fourth, Christmas, and the like, such goods would ordinarily be substantially reduced in price once the specified holiday or other event was past, in order to "move" the merchandise. Thus, a need has existed for a type of package which could be adapted from a specialty nature to a more generic or everyday nature in order to extend the time for which the packaged items could be retailed at a higher price. The only package known to address this problem in any manner is a cellophane package used, for example, to market candy, such as that sold under the registered trademark of Atkinson Candy Company, ATKINSON'S. The Atkinson candy package is of the "form and seal" type which is simultaneously formed, filled with the product and sealed with a central longitudinal seal along the back of the package, and with two transverse end seals. As a separate step, the Atkinson package has added a narrow band bearing a repetitive, random holiday design which may be attached at each end of the package, so as to cross the front thereof at a non-specific angle relative to the longitudinal axis of the bag. The strip is approximately two inches wide and thus does not completely cover the usual, non-holiday printed matter on the approximately five and one-half by nine and one-half inch bag, but may be removed, leaving the bag intact.

Although appropriate for providing information on a thin strip in a random print, repetitive pattern, the Atkinson-type package is not well suited for being provided with a decorative overlay which is broader, or even of the same dimensions as the package front, and particularly when such decorative overlay does not bear a random or repetitive pattern.

The latter type of overlay sheet must be applied to a package surface in registration (precise alignment) therewith. Accurate registration of the overlay and front of a package of the Atkinson form and seal-type is extremely difficult, if not impossible, because the material "web" (source material) for the package per se and that for the decorative strip must be fed from separate "unwind rolls" to a common sealing machine. It is inherent in such packaging processes that the various forces applied throughout cause a certain amount of drag on the material being used to form the bags or other packages. Thus, any materials being fed together will eventually become misaligned, requiring interruption of the process for correction. Therein lies the reason for using merely a random or repetitive design when applying a decorative overlay to the Atkinson-type package.

Accordingly, a need exists for a soft package having a separable decorative overlay (or "fugitive sheet") which may bear a non-repetitive, non-random pattern and so is made part of the package in such manner as to be in registration with a front or back panel thereof and particularly which may be produced in a single web roll process for efficiency of manufacture.

Moreover, unlike the Atkinson-type bag, which is filled and sealed as the bag is formed, there exists a need for a separable package which can be inexpensively mass produced and provided to a wholesaler for filling with the desired goods and subsequent sealing prior to shipping to the retailer.

Other types of packages having separable portions include U.S. Reissue Pat. No. 24,962 to Loderhose, which patent is directed to a cardboard phonograph jacket provided with photographs of a recording artist on the front. The photographs are capable of being peeled off while leaving an intact record jacket therebeneath. The Loderhose paten also discloses rigid multi-walled containers having a front panel with a removable section therein. The removable section is adapted for separating along a perforated tear-line leaving marginal edges adhered as by glue to the multi-walled container.

U.S. Pat. No. 4,955,475 to Beer et al teaches a package for light sensitive materials, the package having multiple light blocking flexible panels, one of which may be peeled away from the others in order to allow access to materials within the package. The panels of the Beer et al package are formed of flexible, light-blocking material made into a complex web-like structure, such as a laminate of a polyester layer, an aluminum foil layer, a nylon layer and a polyethylene layer.

There also exist commonly available cardboard boxes for goods such as facial tissues, the boxes being of a decorative nature and having product or other advertising information printed on a piece of plastic which is glued in part to the outside of the box or glued within a seam joining two portions of the box. This plastic piece can be removed by the customer after purchase to provide a more purely decorative box for use, with no printed information whatever thereon.

There is no prior art relative to a retail package for marketing goods specifically in relation to a certain season or event and having a decorative overlay portion which has been applied in careful registration to the front of the package, which portion may be removed to leave the package intact and allow the continued sale of the goods therein without having to reduce the price after the culmination of the special event or season.

Accordingly, it is among the objects of the present invention to provide a package for retail goods which has a selectively separable portion and a method for producing the package; the separable portion being of a decorative overlay nature for carrying specialty information, as for example, related to a certain holiday or sporting event, and being capable of facile removal from the package as a whole without destroying the useful integrity of the package. The new separable package is intended to be provided with generic or standard product information or advertising on the package proper which may optionally be hidden, entirely or in part, beneath the separable portion so that when that separable or decorative overlay portion is removed, the package is fully functional for containment of the goods without reference to any particular event, holiday, etc.

It is a further object of the present invention having the aforementioned features that the package be of simple, inexpensive construction and be capable of being easily manufactured with conventional automated equipment, as well as being formed after special treatment of the material of the package so that the separable portion may be simply yet properly and quickly removed by an individual having little or no training, while the front and back panels of the soft package remain securely connected to each other.

It is yet another object of the present invention having the features ennumerated that it be amenable to printing by known methods with a variety of messages, such as illustrations relating to specific holidays, in any available colors.

It is still another object of the invention having the above features that the package be capable of production in a number of different shapes, such as square, rectangular, or irregular shapes, and that it may be produced as adapted for hanging from rods (wickets), for filling or display, or for simply stacking on a shelf or table.

It is also among the objects of the present invention having the described features that it be capable of retaining a wide variety of goods, yet be light-weight and either transparent, translucent, or opaque.

Accordingly, in furtherance of the above objects, the present invention is, briefly, a mass-produced package having a separable overlay portion. The package includes a plurality of layered sheets of flexible material having printed information thereon for outward display on the package. Each one of the plurality of layered sheets has an interior surface, and an exterior surface for display of information thereon and a plurality of edges forming a perimeter. At least a portion of the perimeter of each one of the plurality of layered sheets is connected to a corresponding portion of the perimeter of an immediately adjacent layered sheet, and the entire perimeter of one of the plurality of layered sheets is continuously inseparably connected along the entire perimeter of at least one adjacent sheet of the plurality of layered sheets when the package is filled with goods, to thereby provide the package with containment function. An outermost one of the plurality of layered sheets is adapted for quick, facile removal from the remainder of the plurality of layered sheets without disrupting the containment function of the package, thereby altering the information outwardly displayed on the package.

The present invention is also, briefly, a package for containing goods and having an overlay portion which is separable therefrom without disruption of the containment function of the package. The package includes first, second and third flexible sheets each having a plurality of edges and being arranged in registered, layered fashion. The second flexible sheet is layered over the said first flexible sheet and forms the package therewith and the third flexible sheet is layered over the second flexible sheet and forms an overlay portion for the package. Each of the plurality of edges of the second flexible sheet is substantially non-releasably sealed to a corresponding one of the plurality of edges of the first flexible sheet so as to completely seal the package for secure retention of goods contained in the package. At least two of the plurality of edges of the third flexible sheet are releasably sealed to at least two corresponding edges of the plurality of edges of the second flexible sheet, to thereby provide for removal of the third flexible sheet from the package without causing inadvertent separation of the second flexible sheet from the first flexible sheet.

Moreover, the invention is, briefly, a method for manufacturing a package having a separable portion. The method includes:

(a) Providing a web roll of sheet-like flexible material having a first surface and a second surface extending between opposed first and second longitudinal edges, the entire first surface having been pretreated to increase polarity thereof. The second surface has been pretreated to increase polarity only over a strip thereof, the strip having a predetermined width and extending longitudinally along the entire length of the sheet-like flexible material at the second longitudinal edge thereof and extending inward therefrom for a distance substantially equal to the width of the package to be manufactured by the method. The flexible material has been printed in a predetermined pattern on the pretreated first surface thereof.

(b) Forming a first longitudinal fold in the sheet-like flexible material so that a first portion of the untreated area of the second surface faces a second portion of the untreated area of the second surface of the flexible material.

(c) Sealing the flexible material along the first longitudinal fold of step (b) so as to form a continuous non-releasably sealed edge joining two sheets of the flexible material which will become a non-releasably sealed edge on the package to be formed.

(d) Forming a second longitudinal fold in the flexible material in predetermined spaced relation to the first longitudinal fold so that the pretreated strip of the second surface of the flexible material faces in registered, layered fashion a pre-selected, pretreated, printed portion of the first surface of the flexible material adjacent and coextensive with the first longitudinal edge thereof. The second longitudinal edge of the flexible material is substantially parallel to, adjacent to and coextensive with the continuous non-releasably sealed edge formed in step (c).

(e) Making at least one longitudinal cut in the flexible material contiguous with the second longitudinal fold so as to provide an open end on the package opposite the substantially non-releasably sealed edge thereof for permitting filling with goods prior to sealing. And, (f) making a plurality of successive cuts transversely through and entirely across the longitudinally folded flexible material at equal predetermined intervals thereon in order to separate individual packages from the folded flexible material. Simultaneously, opposed transverse edges are formed on the package in such manner that the opposed transverse edges releasably seal the registered layered, pretreated strip of the flexible material to the pretreated, printed longitudinal portion of the flexible material adjacent thereto. Also simultaneously, the transverse edges of the first and second portions of the untreated second surface of the flexible material which were folded into facing relationship in step (b) are non-releasably sealed together. All of the above being to provide a package having a separable portion which may be removed without destroying the containment function of the package.

Other objects will be in part apparent and in part pointed out hereinbelow.

BRIEF DESCRIPTION OF THE DRAWINGS

FIG. 3 is a top plan view of the package of FIG. 1, illustrating goods therein in phantom.

FIG. 3A is a sectional view of the package of FIG. 1 taken on line 3A—3A of FIG. 3.

FIG. 4 is an elevational view of the package of FIG. 1, as a separable portion thereof is being removed.

DESCRIPTION OF PRACTICAL EMBODIMENTS

Figure 1:
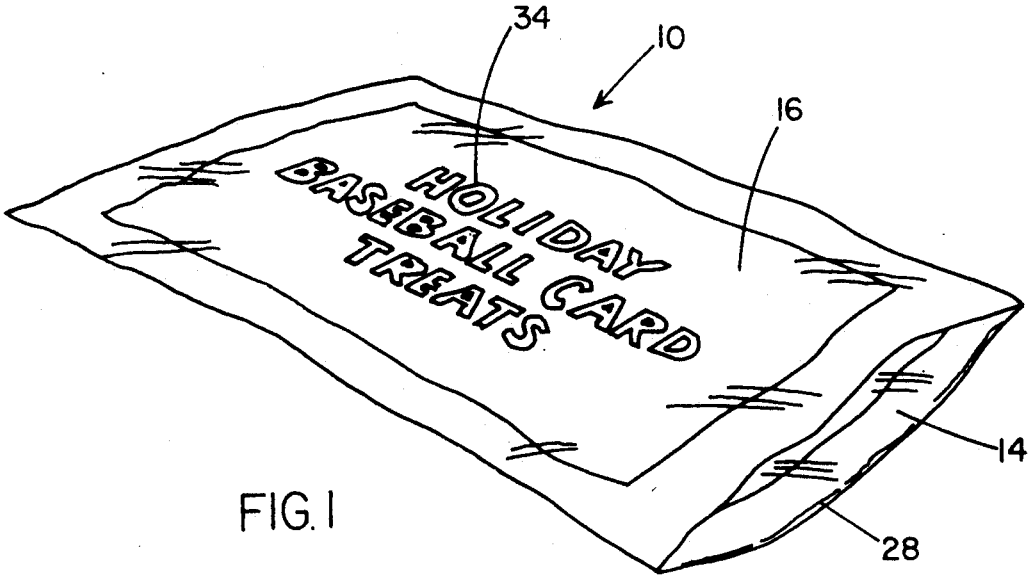
FIG. 1 is a perspective view of one embodiment of a separable package constructed in accordance with and embodying the present invention.

With reference to the drawings, 10 generally designates a first embodiment of the separable package constructed in accordance with and embodying the present invention. FIGS. 1–5 illustrate that package 10 is preferably formed of layered sheets of pliable plastic, such as polyethylene, and includes three such sheets 12, 14 and 16, superimposed in registration one upon the other. For simplicity of discussion, sheets 12, 14 and 16 are considered (with reference to FIG. 2) to be the bottom, middle and top sheets, respectively. Sheets 12 and 14 form a unitary package and sheet 16 is a decorative overlay which may be removed from the package without interrupting the integrity thereof.

Sheet 12 is defined by preferably parallel, opposed longitudinal edges 12*a*, 12*b* which extend between and intersect preferably parallel, opposed end edges 12*c*, 12*d*. Flexible sheet 12 forms an outside wall or back of package 10 and may be provided with informative material on an outer surface 12*f* (FIGS. 10 and 11) thereof in any conventional manner, such as by printing. An inner surface 12*g* of sheet 12 forms the inside back wall of package 10 and an outer surface 12*f* (FIGS. 10 and 11) is provided with printed information of a general nature, as desired.

Middle flexible sheet 14 is defined by preferably parallel, opposed longitudinal edges 14*a*, 14*b* which extend between and intersect preferably parallel, opposed end edges 14*c*, 14*d* in like manner as described in relation to sheet 12. Sheet 14 is disposed substantially parallel and adjacent to bottom sheet 12 which has substantially similar dimensions and forms a front to package 10 with an inner surface 14*f* (FIG. 9) facing inner surface 12*g* of sheet 12. An outer surface 14*g* faces away from the inside of package 10 and is preferably printed with information 20 of a standard general non-seasonal or everyday nature, consisting, for example, of general product information or a brand name.

Corresponding longitudinal edges 12*a*, 14*a* are continuously connected along common sealed edge 22 and likewise, edges 12*b*, 14*b* are contiguous along common sealed edge 24, corresponding longitudinal edges 12*c*, 14*c* are connected without interruption along common sealed edge 26, and edges 12*d*, 14*d* are connected along common sealed edge 28.

Figure 5:
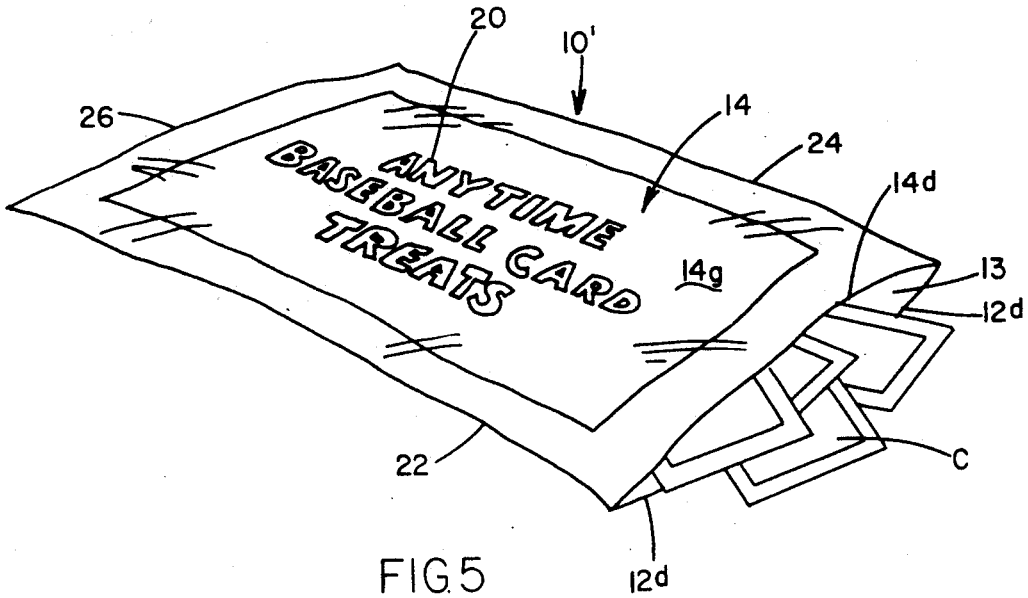
FIG. 5 is a perspective view of FIG. 1 after a portion thereof has been removed and shown open to illustrate goods therein.

FIGS. 3A and 5 illustrate that middle sheet 14 an bottom sheet 12 connected as described, define between them a space or gap 13 for containing therein goods such as, for example, baseball card treats C.

Figure 2:
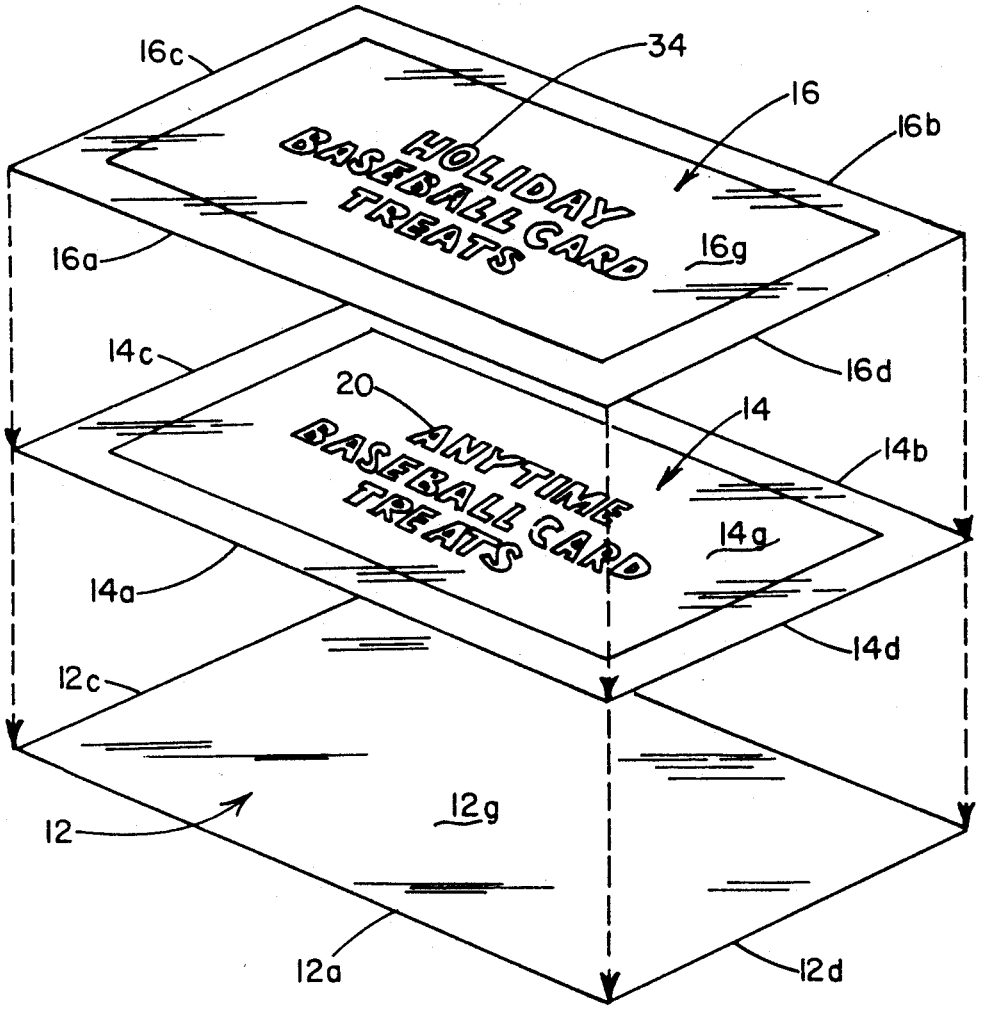
FIG. 2 is an exploded view of the package of FIG. 1 for illustrating the method of the construction thereof.

FIGS. 2 and 4 show that top flexible sheet 16 is superimposed upon middle sheet 14 and is defined by preferably parallel, opposed longitudinal edges 16*a*, 16*b* which extend between and intersect preferably parallel, opposed end edges 16*c*, 16*d*. Sheet 16 includes an outer surface 16*g*, and an inner surface 16*f*. Inner surface 16*f* is positioned adjacent to and facing outer surface 14*g* of middle sheet 14 and is separated therefrom by gap or space 15 (FIG. 3*a*).

Outer surface 16*g* of top sheet 16 is provided, for example, with a special event or holiday message 34 or other information, which, when optionally printed as seen in FIG. 3, substantially blocks from view the standard message 20 of middle sheet 14, previously discussed. Thus outer sheet 16 forms a decorative overlay, which, being removable as hereafter described, provides package 10 with the capability of conversion from a specialty package to a generic (or "everyday" or "anytime") package, for marketing to multiple markets.

Opposed longitudinal edges 16*a*, 16*b* of outer sheet 16 are contiguously connected to corresponding longitudinal edges 14*a*, 14*b* at common sealed edges 22, 24 respectively. Preferably, both end edges 16*c*, 16*d* are left free and unattached, but optionally may be connected at common sealed edges 26, 28, respectively. Or, alternatively, only one such edge 16*c*, 16*d* may be connected at the respective common sealed edge 26, 28, the other, unsealed edge remaining free.

Figure 6:
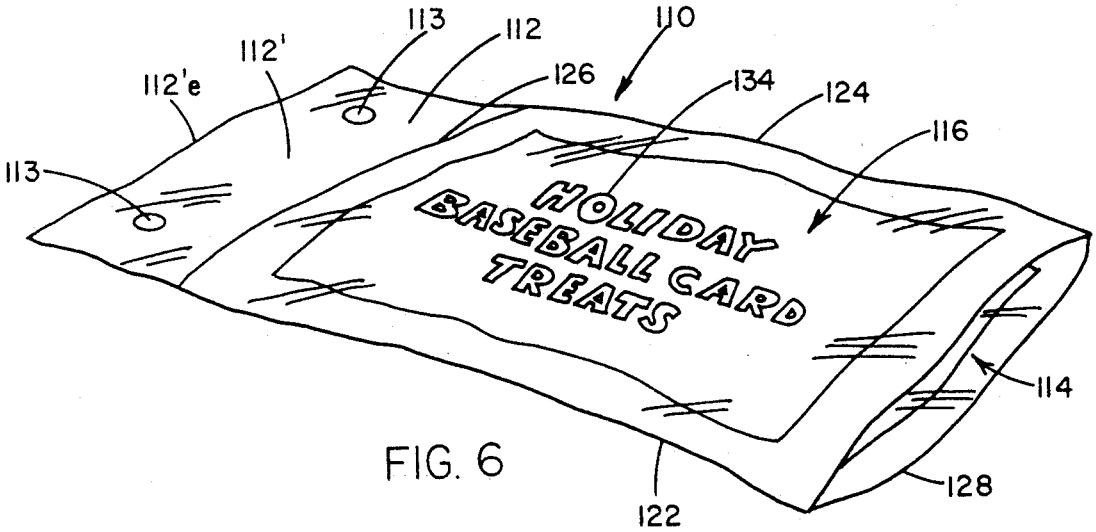
FIG. 6 is a perspective view of a second embodiment of a package constructed in accordance with and embodying the present invention.

FIG. 6 illustrates a second embodiment, generally designated 110, of a separable package constructed in accordance with and embodying the present invention. Package 110 is identical in most respects to package 10, having top sheet 116 connected along common sealed longitudinal edges 122, 124 to middle and lower sheets 112, 114, in like manner as previously discussed in relation to package 10. Likewise, sheets 112, 114 are connected to each other along a common sealed end edge 128. As with package 10, outer or top sheet 116 of this embodiment carries specialty information 134 and may be peelably removed for "generic" or ordinary daily merchandising.

Package 110 differs from package 10 in that the bottom sheet 112 preferably extends lengthwise beyond a transverse seal line 126 along which middle sheet 114 is continuously attached to bottom sheet 112 to form flap 112', which flap terminates in transverse end edge 112'*e*, parallel to seal line 126. Flap 112' is penetrated by at least one and preferably two apertures (or wicket holes) 113 to permit suspension of package 110 as by conventional hooks (not shown) for filling with goods prior to sealing (as hereafter described) and/or for display and marketing, rather than being stocked loosely on store shelves as is package 10.

Alternatively, after filling of package 110 by the wholesaler, flap 112' may be completely removed from package 110 simultaneously with the step of heat sealing package 110 along transverse seal line 126 which would then effectively become a common sealed end edge of the package. In the latter case, package 110 would effectively be converted to package 10.

Figure 7:
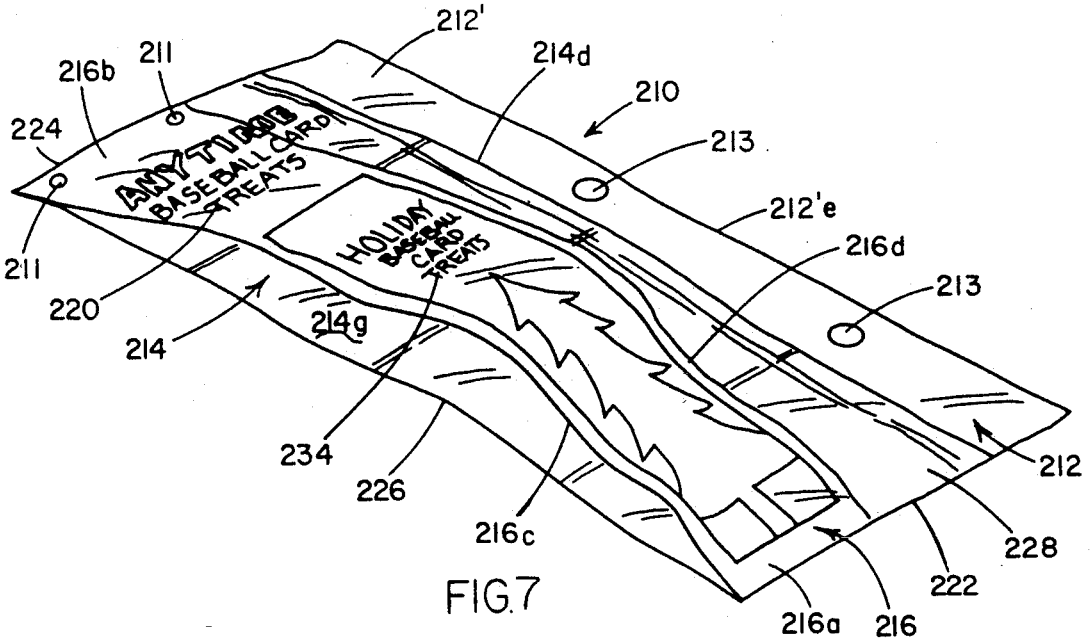
FIG. 7 is a perspective view of a third embodiment of a separable package constructed in accordance with and embodying the present invention.

FIG. 7 illustrates a third embodiment, generally designated 210, of a separable package constructed in accordance with and embodying the present invention. Package 210 is similar to package 10, being constructed in three layered preferably rectangular, flexible sheets, 212, 214, 216 in layered registration. In the illustration, flexible sheet 212 forms a bottom or back of package 210 and extends to form a flap 212' along one longitudinal side of package 210, which flap 212' terminates outwardly in longitudinal flap edge 212'e. Flap 212' has at least two spaced-apart through holes 213 provided along the length thereof for suspension and filling of package 210 by the wholesaler, as explained hereafter. Bottom sheet 212 and middle sheet 214 are joined along a seal line forming a common longitudinal edge 226 of package 210 parallel to longitudinal flap 212'.

A second longitudinal edge, **214*d*, is parallel to outer longitudinal edge 212'*e* and inward thereof. Selectively spaced along the longitudinal axes of co-registered sheets 212, 214, are transverse heat sealed division lines 215 which form pockets 217 for placement therein for goods to be merchandised in package 212 (for example, baseball cards). Middle sheet 214 bears an upper surface 214*g* which at one end thereof is printed with generic or everyday information 220. Positioned in longitudinal registration above middle sheet 214 is top, separable decorative overlay sheet 216 which is joined to sheets 212, 214 along common sealed edges 222, 224. A transparent upper or outer sheet 216 is provided with an outer surface 216*g* upon which is printed a holiday or otherwise special message 234. End edges 216*a* and 216*b* are sealed over sheets 212, 214 along common sealed edges 222, 224. At least one end of sheet 216 is transparent in order to overlay but not block from view the generic message 220 on flexible sheet 214 therebeneath, for example as shown. Inward of one common sealed edge, for example, 224 is at least one and preferably two through holes 211 for suspension of package 210** for display and marketing purposes.

Figure 8:
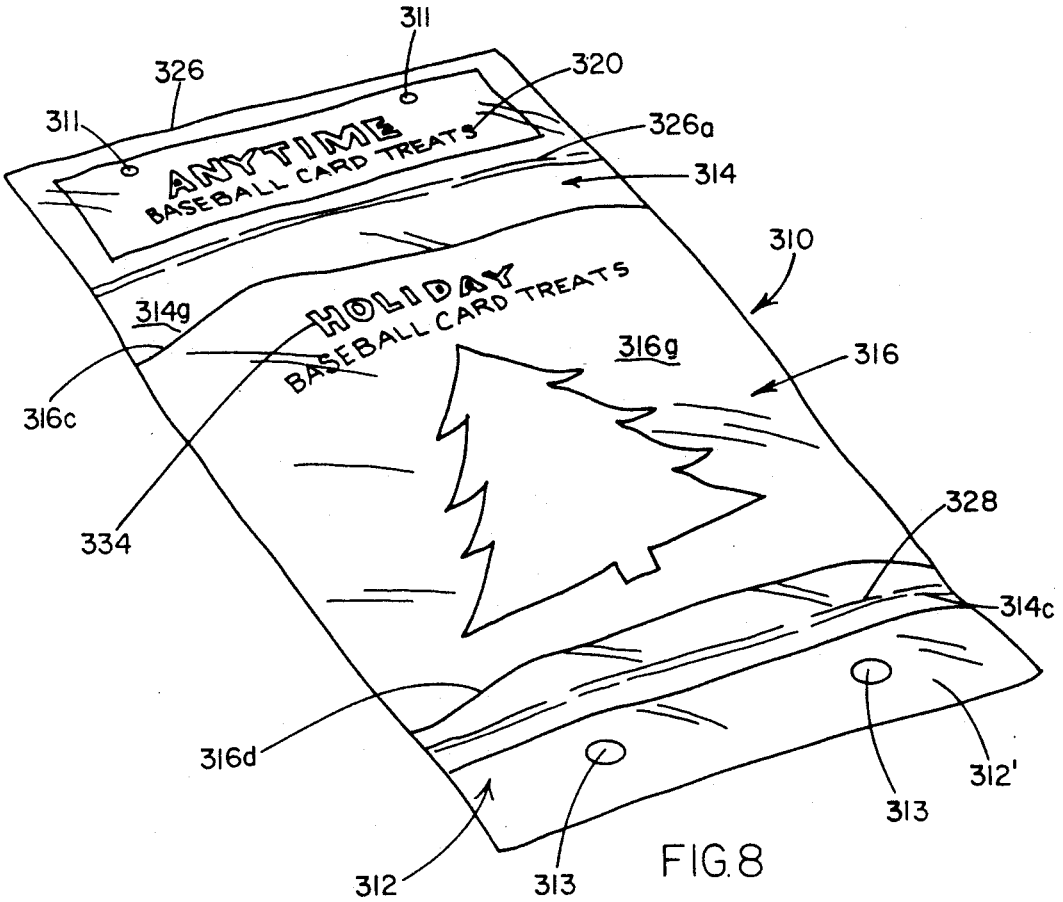
FIG. 8 is a perspective view of a fourth embodiment of a separable package constructed in accordance with and embodying the present invention.

FIG. 8 illustrates a fourth embodiment of a separable package constructed in accordance with and embodying the present invention. Package 310 is similar in many respects to package 10 and the other previously described embodiments, with like parts being similarly numbered.

Like the previous embodiments described, package 310 consists of preferably three layered sheets, bottom or back sheet 312, upon which is superimposed in registration therewith middle sheet 314 and an outer or upper separable overlay sheet 316. Soft package 310 is substantially rectangular, having two common sealed longitudinal edges 322, 324 at which are joined corresponding parallel longitudinal edges of all three layered flexible polyethylene sheets.

Bottom and middle sheets 312, 314, respectively, are joined along common sealed end edge 326 and are also joined inward of edge 326 at a second, parallel common seal line **326*a*. The outer surface 314*g* of middle sheet 314 may, at the end of package 310 bordered by edge 326 have printed thereon a generic or otherwise everyday message 320, preferably positioned between sealed end edge 326 and common seal line 326*a*. Message 320 may also be incorporated into package 310 by printing on a stiff header card (not shown) which is incorporated during manufacture between substantially transparent sheets 312, 314 inward and adjacent to edge 328 to add strength for support of the package during display thereof. Preferably paired through holes 311 penetrate sheets 312, 314 inward from and adjacent to common sealed edge 328 to facilitate display of package 310** by suspension from hooks (not shown).

Opposite of sealed end edge 326 on package 310, back sheet 312 extends outwardly, beyond middle sheet 314 to form flap 312' (which is penetrated by preferably paired through holes 313 for suspension on conventional wickets of bag 310 by a wholesaler for filling with goods prior to sealing, for example, along phantom line 328, inwardly adjacent and substantially parallel to end edge **314*c***.

Outer separable sheet 316 is disposed in registration over middle sheet 314 so that a preprinted holiday or otherwise special greeting 334 on outer surface **316*g* is carefully aligned on package 310. End edges 316*c*, 316*d* of outer separable sheet 316 are preferably left free and unattached in relation to sheets 312, 314 and are disposed such that edge 316*d* is inward, parallel and adjacent to flap 312' and edge 316*c* is adjacent and parallel to and inward of seal line 326*a* so that generic message 320 is not covered by sheet 316**.

Although separable packages 10, 110, 210, 310 are shown and described as being substantially rectangular, it is to be understood that other shapes are equally useful. Soft, flexible plastics other than colorless, transparent polyethylene, such as polypropylene, or tinted or opaque plastics, may suffice and it is foreseeable that more than one separable outer or top sheet 16 may be provided (not shown), either with one overlayering the other, or on opposed sides of package 10 so as to provide a second surface area for additional printed information.

Figure 9:
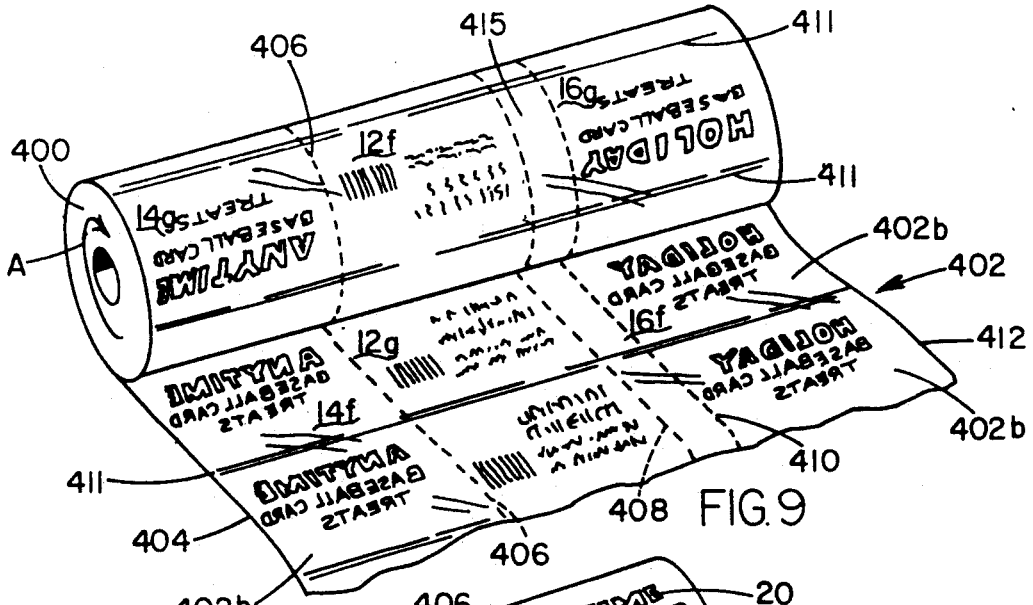
FIG. 9 is a schematic view of a printed web of flexible material for forming the separable package of FIG. 1 as it is rolled onto a web roll after leaving a print roll (not shown) and proceeds to a bagging machine (not shown).
Figure 10:
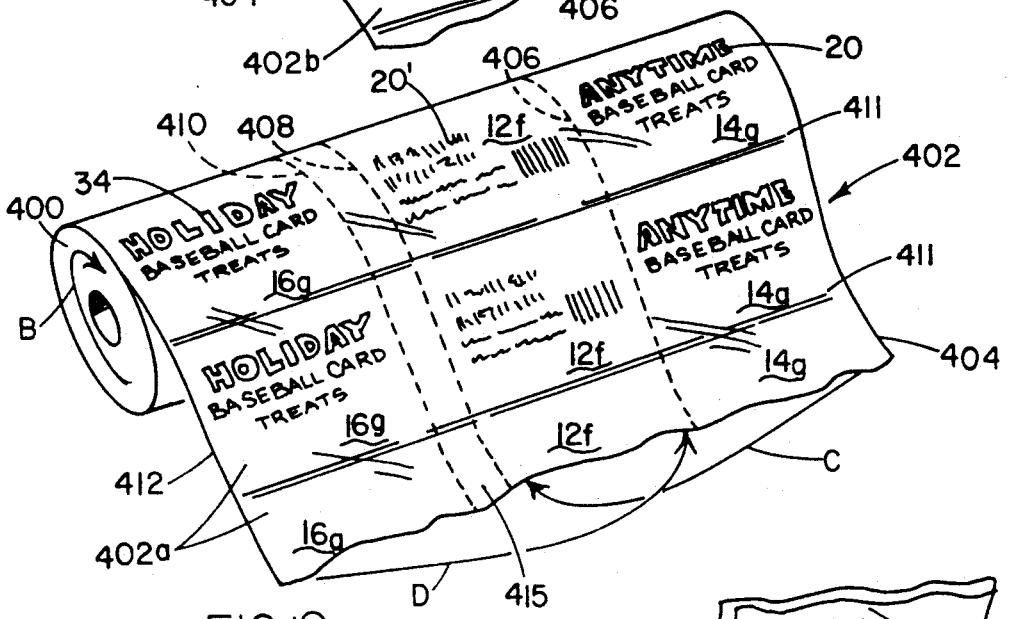
FIG. 10 is a schematic view of the front of the printed web of material shown in FIG. 9 as the web leaves the web roll.
Figure 11:
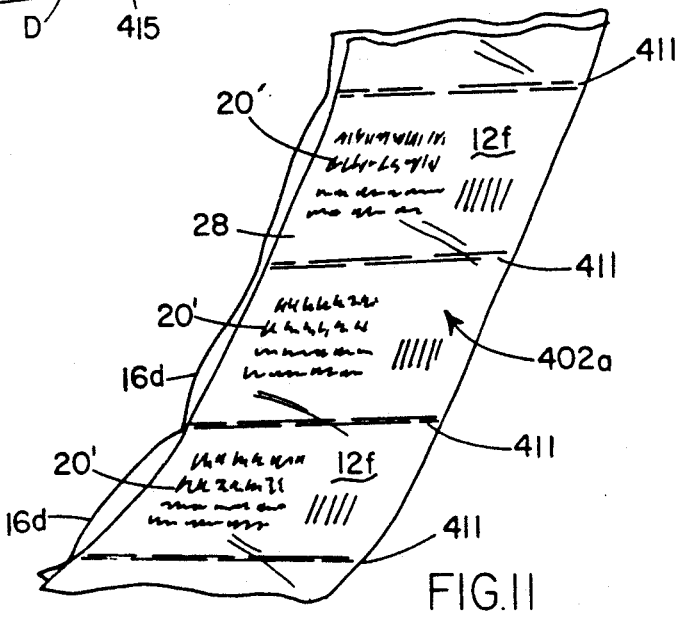
FIG. 11 is a schematic view of the web of material of FIG. 10 after folding and just prior to heat cutting of the separable package of FIG. 1 from the folded web.

FIGS. 9 through 11 schematically illustrate the preferred method of forming separable package 10. It is understood that certain variations in the method which follows can be performed in order to produce the other aforementioned embodiments 210, 310 shown and described as well as other unillustrated versions of the new package.

FIG. 9 schematically illustrates a conventional web roll 400 upon which is being wound in the direction indicated by arrow A, a pretreated (as later described), preprinted web 402 of flexible plastic material from which package 10 is created. Flexible material web 402 is bordered longitudinally by edges 404, 412 and extends continuously therebetween. Broken longitudinal lines 406, 408, 410 and phantom horizontal lines 411 illustrate the various sites upon which web 402 will be folded and cut, as described hereafter to form a multiplicity of packages 10. As shown, the web areas which will form inside surfaces **14*f* of middle sheet 14 are disposed between edge 404 and broken line 406. The panels which will form inner surface 12*g* of outside or back panel 12 are disposed between broken lines 406, 408 (identical width panels being divided along the length of 402 by transverse equidistant broken lines 411). A longitudinal strip of waste plastic material is indicated at 415 between longitudinal broken lines 408, 410. The panel which forms outer, separable sheet 16 of package 10 is disposed between longitudinal broken line 410 and outer edge 412 of web 402 as divided by transverse broken lines 411 and indicated as 16***f*, ultimately the inner, unprinted surface of panel 16.

FIG. 9 also illustrates the messages 34, 20, 20' of panel surfaces 14*g*, 12*f* and 16*g* printed along web 402 on web roll 400 so as to be appropriately positioned on package 10 when the manufacturing process is complete.

FIG. 10 schematically illustrates the web roll 400 and web 402 of FIG. 9 from the opposite side, as web 402 unrolls (as indicated by arrow B) toward a conventional bagging machine (not shown). As in FIG. 9, the longitudinal broken lines 406, 408, 410 and transverse phantom lines 411 previously discussed indicate fold or cut lines as required by the method of the invention. They are not necessarily actually printed on the material web.

With further reference to FIG. 10, outer surface 16*g* of removable panel 16 is longitudinally repeated between outer edge 412 and broken line 410 as divided by transverse lines 411. Longitudinal broken lines 408, 410 illustrate a removable waste strip of polyethylene or other preselected flexible web material. Outer surface 12*f* of back panel 12 is printed between broken lines 406, 408 and is repeated at regular predetermined intervals as illustrated, for example, between transverse lines 411. Outer surface 14*g* of panel 14, carrying generic message 20 is shown as repeated longitudinally between line 406 and outer edge 404 and divided transversely by phantom lines 411.

For manufacture of bag 10, it is necessary that web 402 is first treated in a particular manner, preferably by a known corona discharge method to enhance the printing and sealing processes. Such methods have been in use to cause the treated surface to be more polar, thus more wettable and receptive to chemicals such as inks, applied to the surface thereafter. Other methods of inducing this polarity on the appropriate surface areas may also suffice. However, it is critical that only specific areas of web 402 are so treated. All areas of the web which will be printed with letters or decorative material must be treated, as is often necessary for enhancing the usual printing process. The area treated includes the entire front surface 402*a* of web 402 (shown in FIG. 10 as carrying repeat panels for surfaces 16*g*, 12*f* and 14*g*). However, on the back surface 402*b* of web 402 only the web area between longitudinal broken line 410 and outer edge 412, which area becomes panel surfaces 16*f* of package 10 are corona discharge treated. The remainder of back surface 402*b* of web 402 between outer edge 404 and broken line 410 is specifically, and intentionally left untreated.

Thereafter, as shown in FIG. 10, web 402 is folded (or "centerfolded") as indicated by arrow C along broken line 406 such that each panel 14 is in predetermined registered alignment beneath the adjacent panel 12 so that untreated surfaces 14*f* and 12*g* of corresponding adjacent panels face each other.

Simultaneously with the formation of the first fold, as indicated by arrow C, a heat seal is formed along longitudinal line 406, thereby tightly closing one end of package 10, as indicated in FIG. 5 as common sealed edge 26. Edge 26 is formed as a seal line which does not easily release because the surfaces 14*f*, 12*g* which are folded so as to face each other, have not been corona discharge treated. Similarly, the transverse heat seals eventually formed along phantom lines 411, as described hereafter between longitudinally adjacent formed bags 10, specifically between sheets 12 and 14 are extremely strong, especially relative to the bond formed by outer sheet 16 to sheet 14, because the adjacent surfaces of layered sheets 12 and 14 were not corona discharge treated.

Arrow D indicates a second continuous fold step for preparation of web 402 such that each panel 16 is in layered registration beneath the adjacent panels 12, 14 (previously folded). Upon formation of the second fold of web 402, outer edge 412 is in alignment with line 406. Treated inner surface 16*f* of decorative overlay 16 and treated outer surface 14*g* of middle sheet 14 then face each other and are readily separable after being sealed because the facing surfaces have both been treated as described. If only one of the two facing surfaces had been treated the seals therebetween would release somewhat more readily than when neither is treated, but not as easily as when both are treated.

Immediately after formation of fold D, or substantially simultaneously therewith, depending on the preselected adjustment of the machine, waste strip 415 is removed as by automated cutting along lines 408, 410.

As the described automated folding and cutting is occurring, the progress and position of web 402 is monitored by an "electric eye" to detect if the pre-printed panel designs have strayed in the least from their preselected registered positions. If any shifting of the position of web 402 is detected, it is immediately, automatically adjusted before such misalignment is so extreme that any packages are improperly formed. Any large degree of misalignment of the layered panels would have the result that either the decorative overlay sheet would not be neatly and easily removable (because the treated and untreated surfaces would not be in the arrangement necessary for the desired releasability or non-releasability of particular joined edges) or that the integrity of the package would be destroyed as the removable panel is separated (or both).

Folds C and D continuously occur as web 402 is fed in the configuration of a flattened tube 402*a* toward a conventional bagging machine (not shown) as illustrated schematically in FIG. 11. At the bagging machine transverse cuts are made as, for example, by a heat bar along phantom lines 411 to separate each bag 10 from the tube-like folded web 402*a*. Thus, the bags (separable packages) 10 are preferably produced in an open-ended form for empty delivery to a wholesaler who then optionally suspends the package from wickets inserted through wicket holes as shown in the embodiments of FIGS. 6, 7 and 8, and fills the bags with the desired merchandise prior to sealing and forwarding them on to a retailer for ultimate consumer consumption.

The process for forming common sealed edge 28 may vary. That edge will preferably be sealed after package 10 is filled by a wholesaler (rather than by the manufacturer), who may optionally choose to seal one corresponding end of all three panels 12, 14, 16 simultaneously together along a transverse line, in one step, or to leave end edge 16*c* of decorative overlay 16 free and unattached to ends 12*c*, 14*c* at common seal line 26. Alternatively, the wholesaler may prefer to leave a tab such as 112' of package 110 available for hanging the package (FIG. 6) for filling, or remove the excess entirely so that the remaining package is that embodiment designated 10 in the first five figures herein.

Similarly, packages 210, 310 may be suspended by insertion of hooks (not shown) through wicket holes 213, 313, respectively, for filling with goods prior to sealing along phantom lines 228, 328, respectively.

Ordinarily common seal line 28, 228 or 328 will be a further heat seal (described in detail hereafter), but may optionally be accomplished by other package closing means, such as a zipper lock-type closure or by tape, possibly even tamper-evident tape to ensure the constant pre-purchase integrity of packages used to contain goods to be taken internally, such as candy, coughdrops, etc.

In addition to the necessary pretreatment of web 400, previously discussed, the releasability of decorative overlay sheet 16 from the remainder of package 10 and the simultaneous retention of the seals between sheets 12 and 14 are also affected by other factors.

Specifically, in the method of manufacturing the above-described separable packages the heat seals are formed using the known "side-weld" principle which makes use of a seal bar (or "hot knife") for sealing and/or cutting the various edges and seams. This hot knife is preferably a 1/64-inch radius chrome plated sealing bar. When used with approximately 2 mil (0.002 inches) polyethylene sheeting material this bar forms a very fine "seal bead" at the sealed edge. This preferred knife edge is substantially smaller than the 1/32 inch radius bar generally used for 2 mil polyethylene packages.

The described, formed fine seal is usually sufficient to permit release of the overlay sheet, while simultaneously retaining the contiguous seal of all edges joined between the two essential package sheets (e.g. 12, 14). However, the weight of plastic used may be selectively varied as necessary depending upon the shape and/or weight of the particular goods to be packaged and ranges generally from 0.5 to 10 mils. Also, as heavier plastic is used a larger seal bar must be used and generally be varied from approximately 1/64- to 3/64-inch radius, as necessary.

Additionally, the temperature of the seal bar may be varied to affect the seal strength, and to take into account the plastic weight used. The temperature range generally is 500° F. to 1,000° F., and preferably is from 600° F. to 750° F. Of course, dwell time of the bar against the plastic film will also affect the bead size and strength of the seal and may be varied as desired. This "dwell time in all cases will be only a small fraction of a second, but may nonetheless be varied by simple machine adjustment.

As a specific example, using 1.8 mil thickness polyethyl- ene web, 80 separable bags 10 can be formed at a 0.75 second cycle per bag, using a 1/64-inch radius knife at 710° F. with a dwell time of 0.2 seconds for each transverse cut on a phantom line 411.

It is to be understood that although all equipment used in the steps of folding, sealing and cutting in the preferred method is known, that the particular placement of corona discharge treatment, careful printing and series of folds to position the various panels in registration, is unique and allows outer decorative overlay sheet 16 to be facilely removed by the retailer when appropriate, without interrupting the integrity of the common edge seals between sheets 12 and 14.

By ordering from a supplier rolled flexible material web which has been corona discharge treated on the appropriate surface portions thereof prior to any desired printing, and then adjusting the necessary automated equipment to make the folds, heat seals and cuts at the appropriate places, the manufacturer can produce separable soft packages in keeping with the preferred embodiments described, or variations thereof as desired, to provide packages having a separable decorative overlay for retaining any of a wide variety of goods.

Computerized bag making equipment which is useful for production of the new separable package as described is known and is exemplified by the Polystar 8000 30W High Speed Automatic Wicketer produced by RO-AN Industries of Middle Village, N.Y. Other such equipment is available from GUARD ASSOCIATES, INC. of Denver, Colo., for example. The described method for forming the new separable package from a single web roll in a continuous automated manner is preferred for speed and accuracy, permitting production of approximately 75 to 200 of the described bags per minute. Computerized adjustments and electronic eye monitoring of the printed matter on web 402 are provided to maintain layering of panels such as 12, 14, 16 in precise registration and permit rapid, inexpensive production of large quantities of the new separable package while maintaining the quality of appearance and performance thereof.

It is conceivable that the new package could be produced in generally the same manner, but without use of the most highly automated equipment presently available. For example, bag 10, or variations thereof may be formed by feeding two separately printed web rolls together. By this method, however, one web roll would be printed with the removable, decorative overlay and the other with front and back panel information required for the main body portion of the bag. The latter web roll would have to be folded separately, and the two webs fed together to form the separable package. However, use of tension control equipment (not shown) would also be required in order to maintain the two webs in proper registration so that the removable overlay sheet did not become misaligned and then cut and sealed at an inappropriate place. Thus increasing the time and expense required for production.

Of course, although not feasible for large scale production because of time considerations, a similar package could also be produced by hand cutting and sealing the panels thereof in the appropriate order. However, in each of the latter two methods described it is still critical that various package panels be appropriately corona discharge treated or left untreated in the order previously described for the preferred single web roll method and that the sealed edges of the package be appropriately formed (as heretofore discussed), both to ensure that the separable decorative overlay be capable of quick, simple removal while the front and back panels of the package per se remain secured to one another, retaining the goods therebetween packaged as for ordinary day to day sales.

In ultimate application, the retailer may effectively have at least double use of a particular package of goods when using the new separable package. For example, holiday baseball card treats C may be provided on the shelves in separable package 10 until the particular holiday, for example, Halloween, is past. At that point, the retailer may have an employee quickly modify the packages for general sales purposes, as illustrated for example in FIG. 4, by gripping a package 10 with a right hand R positioned adjacent common sealed edge 28 and gripping top sheet 16 adjacent end edge **16*d* as by a left hand L and peeling the same away from middle sheet 14 to leave package 10', as shown in FIG. 5, without top sheet 16. Thus the generic or "everyday" message, such as that shown and indicated at 20 will remain on the front of package 10'** which is left intact, as is essential in regard to containment of goods C. Use in this manner results in the benefit that passage of the special event, season or holiday will not cause the packages to be outdated, which ordinarily entails a large price reduction, or "clearance pricing, in order to move the merchandise from the retailer to the customer. Accordingly, great financial gains are to be realized by the retailer as substantial lost profits can effectively be eliminated.

Moreover, by application of UPC code or other price labels (not shown) on the outside of bottom sheet 12 no alteration of price is necessary. That is, removal of top sheet 16 and its special message 34 will not require removal and replacement of the price label (unshown). The removal of top sheet 16 by an unskilled employee requires no greater labor than that required in affixing new, "reduced price" labels as is ordinarily necessary. Thus, while entailing perhaps approximately the same amount of labor as for repricing goods packaged conventionally (if not less), the profits on post-season packages e.g. 10' are not reduced and a considerable net benefit is realized.

Accordingly, it may be seen that the new separable package is a revolutionary development in soft package marketing of retail goods, such as candy and other treats.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A method for manufacturing a package having a separable portion, said method comprising:

(a) providing a web roll of sheet-like flexible material having a first surface and a second surface extending between opposed first and second longitudinal edges, the entire first surface having been pretreated to increase polarity thereof and the second surface having been pretreated to increase polarity only over a segment thereof, the segment having a predetermined width and extending longitudinally along the entire length of the sheet-like flexible material at the second longitudinal edge thereof and extending inward therefrom for a distance substantially equal to the width of the package to be manufactured by said method, the flexible material having been printed in a predetermined pattern on the pretreated first surface thereof;

(b) forming a first longitudinal fold in the sheet-like flexible material so that a first portion of the untreated area of the second surface faces a second portion of the untreated area of the second surface of the flexible material;

(c) sealing the flexible material along the first longitudinal fold of step (b) so as to form a continuous non-releasably sealed edge joining two sheets of the flexible material which will become a non-releasably sealed edge on the package to be formed;

(d) forming a second longitudinal fold in the flexible material in predetermined spaced relation to the first longitudinal fold so that the pretreated strip of the second surface of the flexible material faces in registered, layered fashion a pre-selected, pretreated, printed portion of the first surface of the flexible material adjacent and coextensive with the first longitudinal edge thereof, and the second longitudinal edge of the flexible material is substantially parallel to, adjacent to and coextensive with the continuous non-releasably sealed edge formed in step (c);

(e) making at least one longitudinal cut in the flexible material contiguous with the second longitudinal fold so as to provide an open end on the package opposite the substantially non-releasably sealed edge thereof for permitting filling with goods prior to sealing; and (f) making a plurality of successive cuts transversely through and entirely across the longitudinally folded flexible material at equal predetermined intervals thereon in order to separate individual packages from the folded flexible material and to simultaneously form opposed transverse edges on the package in such manner that the opposed transverse edges releasably seal the registered layered, pretreated strip of the flexible material to the pretreated, printed longitudinal portion of the flexible material adjacent thereto and to simultaneously non-releasably seal together the transverse edges of the first and second portions of the untreated second surface of the flexible material which were folded into facing relationship in step (b), whereby to provide a package having a separable portion which may be removed without destroying the containment function of the package.

2. The method of claim 1, and further comprising the steps of treating the web roll by corona discharge treatment entirely over the first surface to increase polarity thereof and treating the second surface by corona discharge to increase polarity only over a segment thereof, the segment having a predetermined width and extending longitudinally along the entire length of the sheet-like flexible material at the second longitudinal edge thereof and extending inward therefrom for a distance substantially equal to the width of the package to be manufactured by said method, and printing the flexible material in a predetermined pattern on the treated first surface thereof such that when folded and sealed according to the method of claim 1, the package which is ultimately formed has a separable portion provided with information of a special nature, the separable portion being easily separable from the package, thereby removing the information of a special nature.

3. The method of claim 1, wherein step (b) includes forming the first longitudinal fold such that the first portion of the untreated second surface and the second portion of the untreated second surface of flexible material are of equal width.

4. The method of claim 1, wherein step (b) includes introducing a narrow strip of stiff material into the first longitudinal fold to thereby provide one end of the package with increased strength to facilitate display of the package.

5. The method of claim 1, wherein step (b) includes forming at least one aperture through the first longitudinal fold in the sheet-like flexible material and the strip of flexible material therein for receipt of means to facilitate display of the package.

6. The method of claim 1, and further wherein the first longitudinal fold of step (b) is formed so that the first portion of the untreated second surface is narrower than the second portion of the untreated second surface of flexible material.

7. The method of claim 1, and further comprising the step of forming transverse heat seal lines at preselected positions along the flexible material to thereby form pockets in the package.

8. The method of claim 1, wherein step (c) is accomplished by heat sealing.

9. The method of claim 6, and further comprising making two longitudinal cuts in the flexible material contiguous with the second longitudinal fold and parallel thereto, and removing a strip of flexible material between the two longitudinal cuts such that a flap is formed so as to have a free edge parallel to the first longitudinal edge of the flexible material and extending outwardly therefrom, and wherein step (e) further includes forming a plurality of apertures through the flap for receipt of a means for suspending the package to thereby facilitate filling thereof.

* * * * *